US009337571B2

(12) United States Patent
Furuya et al.

(10) Patent No.: US 9,337,571 B2
(45) Date of Patent: May 10, 2016

(54) SEALING MEMBER AND SEALING STRUCTURE

(71) Applicant: Yazaki Corporation, Tokyo (JP)

(72) Inventors: Yoshinobu Furuya, Kakegawa (JP); Ryuta Takishita, Kakegawa (JP); Go Yamada, Kakegawa (JP); Masaaki Iwabe, Kakegawa (JP); Toshiki Hirata, Kakegawa (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/164,448

(22) Filed: Jan. 27, 2014

(65) Prior Publication Data

US 2014/0213088 A1 Jul. 31, 2014

(30) Foreign Application Priority Data

Jan. 28, 2013 (JP) ..... 2013-013073

(51) Int. Cl.
*H01R 13/52* (2006.01)

(52) U.S. Cl.
CPC ..... *H01R 13/5219* (2013.01)

(58) Field of Classification Search
CPC ..... H01R 13/5219; H01R 13/5221; H01R 13/5208
USPC ..... 439/271–275
See application file for complete search history.

(56) References Cited

U.S. PATENT DOCUMENTS 4,944,688 A * 7/1990 Lundergan ..... 439/275
5,336,101 A * 8/1994 Kasugai et al. ..... 439/272
5,492,487 A * 2/1996 Cairns et al. ..... 439/273
5,713,761 A * 2/1998 Okayasu ..... 439/595
5,782,658 A * 7/1998 Maegawa et al. ..... 439/595
6,045,383 A * 4/2000 Fujiwara ..... 439/271

(Continued)

FOREIGN PATENT DOCUMENTS

CN 1874075 A 12/2006
CN 102044796 A 5/2011

(Continued)

OTHER PUBLICATIONS

Office Action dated Aug. 5, 2015, issued by the State Intellectual Property Office of the People's Republic of China in counterpart Chinese Application No. 201410042241.2.

(Continued)

*Primary Examiner* — Thanh Tam Le
(74) *Attorney, Agent, or Firm* — Sughrue Mion, PLLC

(57) ABSTRACT

A sealing member configured to be installed to an outer peripheral surface of a first connector housing among a pair of connector housings seal so as to seal a gap between an outer peripheral surface of a first connector housing and an inner peripheral surface of a second connector housing is provided. An inner peripheral surface of the sealing member is formed with protrusions and grooves which are aligned with a first wavelength in an axial direction of the sealing member. An outer peripheral surface of the sealing member is formed with protrusions and grooves which are aligned with a second wavelength in the axial direction. The first wavelength is equal to or smaller than the second wavelength. Positions of the protrusions of the inner peripheral surface are shifted from positions of the protrusions of the outer peripheral surface in the axial direction.

13 Claims, 6 Drawing Sheets

(56) References Cited

U.S. PATENT DOCUMENTS

| | | | | |
|---|---|---|---|---|
| 6,244,886 | B1 * | 6/2001 | Strang et al. | 439/271 |
| 6,443,764 | B2 * | 9/2002 | Makita | 439/587 |
| 6,913,494 | B2 * | 7/2005 | Ward et al. | 439/752 |
| 6,994,590 | B2 * | 2/2006 | Nishida | 439/587 |
| 7,033,201 | B2 * | 4/2006 | Ichida et al. | 439/352 |
| 7,044,762 | B1 | 5/2006 | Hong et al. | |
| 7,611,369 | B2 * | 11/2009 | Matsunaga | 439/271 |
| 7,785,145 | B2 * | 8/2010 | Menez | 439/587 |
| 8,187,042 | B2 * | 5/2012 | Kimura | 439/752 |
| 8,215,987 | B2 | 7/2012 | Yoshioka et al. | |
| 8,403,693 | B2 * | 3/2013 | Uchida | 439/271 |
| 8,777,648 | B2 * | 7/2014 | Kitajima et al. | 439/271 |
| 2009/0035976 | A1 | 2/2009 | Matsunaga | |
| 2011/0086544 | A1 | 4/2011 | Yoshioka et al. | |
| 2011/0217859 | A1 | 9/2011 | Kimura | |

FOREIGN PATENT DOCUMENTS

| | | | |
|---|---|---|---|
| CN | 102195183 | A | 9/2011 |
| JP | 10199610 | A | 7/1998 |

OTHER PUBLICATIONS

Office Action dated Mar. 2, 2016, issued by the State Intellectual Property Office of P.R. China in counterpart Chinese Application No. 201410042241.2.

* cited by examiner

SEALING MEMBER AND SEALING STRUCTURE

BACKGROUND

The present invention relates to a sealing member and a sealing structure, and especially relates to an annular sealing member, whose outer and inner peripheral surfaces are formed with protrusions and grooves, and a sealing structure which uses the sealing member.

For example, a patent document 1 discloses a sealing structure in which a pair of cylindrical connector housings fitted with each other are included, an annular sealing member (for example, rubber packing) is installed to the outer peripheral surface of a first connector housing, and when a second connector housing is fitted to the first connector housing, the gap between the outer peripheral surface of the first connector housing and the inner peripheral surface of the second connector housing is sealed by the sealing member.

In the patent document 1, a cylindrical retainer, which prevents the sealing member from being detached from the rear side opposite to the installing direction of the sealing member, is installed to the outer peripheral surface of the first connector housing, and the end part of the retainer at the sealing member side is formed with a pressing part overlying the rear end part of the sealing member. Thus, even if when there is a deviation in the contacting state between the distal end part of the second connector housing at the fitting direction and the rear end part of the sealing member at the time of fitting these two connector housings, the sealing member is made to be detached from the outer peripheral surface of the first connector housing by the force to fit these two connector housings, because the pressing part of the retainer overlies the rear end part of the sealing member, the sealing member can be prevented from being curled.

[Patent document 1] Japan Patent Publication No. 10-199610

SUMMARY

According to one aspect of the present invention, there is provided a sealing member, configured to be installed to an outer peripheral surface of a first connector housing among a pair of connector housings so as to seal a gap between the outer peripheral surface of the first connector housing and an inner peripheral surface of a second connector housing among the pair of the connector housings, wherein an inner peripheral surface of the sealing member is formed with protrusions and grooves which are aligned with a first wavelength in an axial direction of the sealing member, an outer peripheral surface of the sealing member is formed with protrusions and grooves which are aligned with a second wavelength in the axial direction, the first wavelength is equal to or smaller than the second wavelength, and positions of the protrusions of the inner peripheral surface are shifted from positions of the protrusions of the outer peripheral surface in the axial direction.

The sealing member may be configured such that: positions of tops of the protrusions of the outer peripheral surface and positions of bottoms of the grooves of the inner peripheral surface coincide with each other in the axial direction.

The sealing member may be configured such that: a height of the protrusions of the inner peripheral surface from the grooves of the inner peripheral surface is smaller than a height of the protrusions of the outer peripheral surface from the grooves of the outer peripheral surface.

The sealing member may be configured such that: at least one of two end parts of the inner peripheral surface of the sealing member in the axial direction is formed with a flat surface, and a height of the flat surface from the grooves of the inner peripheral surface is equal to the height of the protrusions of the inner peripheral surface from the grooves of the inner peripheral surface.

According to another aspect of the present invention, there is provided a sealing structure, comprising:

a first connector housing;

a second connector housing; and a sealing member, installed on an outer peripheral surface of the first connector housing so as to seal a gap between the outer peripheral surface of the first connector housing and an inner peripheral surface of the second connector housing, wherein an inner peripheral surface of the sealing member is formed with protrusions and grooves which are aligned with a first wavelength in an axial direction of the sealing member, an outer peripheral surface of the sealing member is formed with protrusions and grooves which are aligned with a second wavelength in the axial direction, the first wavelength is equal to or smaller than the second wavelength, and positions of the protrusions of the inner peripheral surface are shifted from positions of the protrusions of the outer peripheral surface in the axial direction.

The sealing structure may be configured such that: positions of tops of the protrusions of the outer peripheral surface and positions of bottoms of the grooves of the inner peripheral surface coincide with each other in the axial direction.

The sealing structure may be configured such that: the outer peripheral surface of the first connector housing is formed with a step portion which rises up therefrom; a front surface of the sealing member in an installing direction in which the sealing member is installed to the first connector housing faces the step portion; a front end part of the inner peripheral surface of the sealing member in the installing direction is formed with a flat surface; and a height of the flat surface from the grooves of the inner peripheral surface is equal to the height of the protrusions of the inner peripheral surface from the grooves of the inner peripheral surface.

The sealing member may have an annular shape, and the first connector housing and the second connector housing may have a cylindrical shape.

DETAILED DESCRIPTION OF EXEMPLIFIED EMBODIMENTS

The inner and outer peripheral surfaces of a traditional sealing member are formed with annular protrusions and grooves in the axial direction. In the patent document 1, because the retainer covers the rear end part of the sealing member, the distal end part of the second connector housing is not caught by the rear end part of the sealing member at the time of fitting these two connector housings, but the protrusion part of the sealing member is pushed to the distal end part of the second connector housing and deforms in a predetermined direction.

Figure 6A:
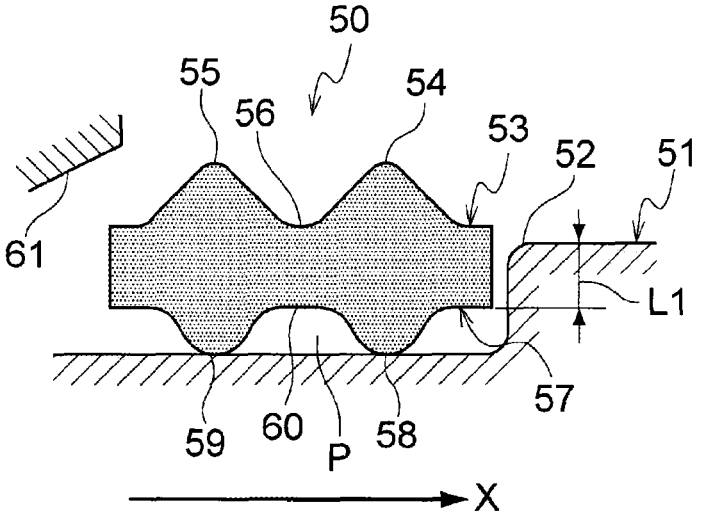
FIGS. 6A to 6C are sectional views which show that a traditional sealing member is pressed against connector housings and deforms.
Figure 6B:
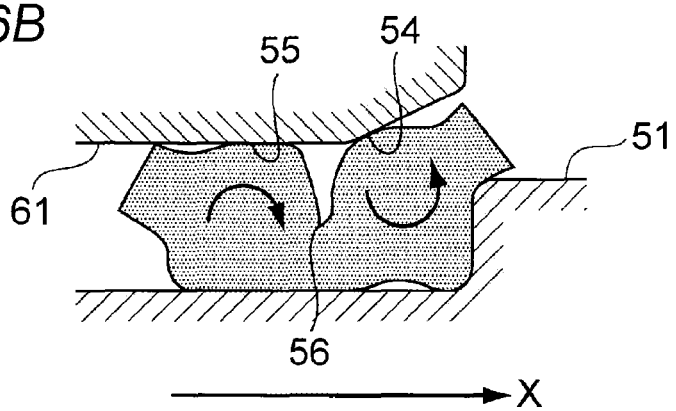
Figure 6C:
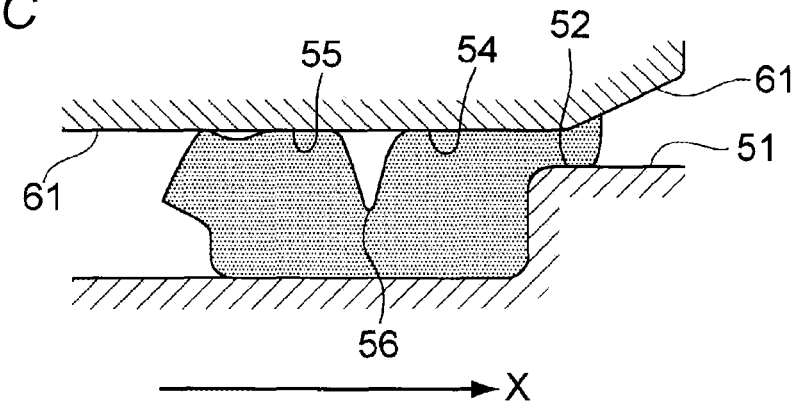

FIGS. 6A to 6C are sectional views which show that the sealing member which is installed to the first connector housing is pushed to the distal end part of the second connector housing and deforms. As shown in FIG. 6A, a sealing member 50 is installed along a step portion 52 of the outer peripheral surface of a first connector housing 51, and the protrusion parts of both the inner and outer peripheral surfaces are formed to coincide with each other in the axial direction. An outer peripheral surface 53 of the sealing member 50 is formed with two protrusion parts 54, 55 and one groove part 56, and an inner peripheral surface 57 of the sealing member 50 is also formed with two protrusion parts 58, 59 and one groove part 60. An arrow X in FIG. 6 shows a direction in which a second connector housing 61 is fitted, and the side to which the arrow is directed is specified as the front side.

As shown in FIG. 6B, when the second connector housing 61 is pushed to the front side, the distal end part of the second connector housing 61 presses the rear protrusion part 55 of the outer peripheral surface 53 of the sealing member 50. Thereby, the adjacent groove part 56 of the outer peripheral surface 53 is pushed toward the inner peripheral surface 57 with the protrusion part 55 as the fulcrum, and with the deformation, the front protrusion part 54 falls down toward the inner peripheral surface 57 of the groove part 56. Then, the front end part of the sealing member 50 is raised up with the deformation of the protrusion part 54. In other words, in the sealing member 50, these two protrusion parts 54 and 55 of the outer peripheral surface 53 rotate and deform in the arrow direction.

Subsequently, as shown in FIG. 6C, when the second connector housing 61 is further pushed forward, the front end part of the sealing member 50, which has risen up, rides onto the step portion 52 and is caught in a space between the second connector housing 61 and the step portion 52 of the first connector housing 51. Therefore, the second connector housing 61 cannot be pushed to a proper position. In this case, if the inner peripheral surface 57 of the sealing member 50 is formed into a plane surface, the front end part can be inhibited from being caught with the deformation of the sealing member 50, but because the sealing pressure is scattered and the waterproofness is decreased, it is necessary for the inner peripheral surface 57 to be formed with the protrusion and groove parts.

It is therefore one advantageous aspect of the present invention to provide a sealing member, which is formed with protrusions and grooves on its inner and outer peripheral surfaces, and prevented from being caught.

Next, the sealing member, in which the present invention is applied, and an embodiment of the sealing structure using the sealing member will be described with reference to figures.

The sealing structure of the embodiment, for example, is applied in a waterproof connector or the like which is loaded in a vehicle. Among a pair of cylindrical connector housings, an annular sealing member is installed to the outer peripheral surface of a first connector housing (hereinafter referred to as female housing), and when a second connector housing (hereinafter referred to as male housing) is made to be fitted to the female housing, the gap between the outer peripheral surface of the female housing and the inner peripheral surface of the male housing is sealed by the sealing member, but the constructions of the female housing, the male housing and the sealing member are not limited to the example of the embodiment. For example, the pair of connector housings are not limited to be cylindrical respectively, and may be formed into a rectangular tube-like shape. The sealing member is not limited to be annular, and may be formed into a rectangular tube-like shape.

Figure 1:
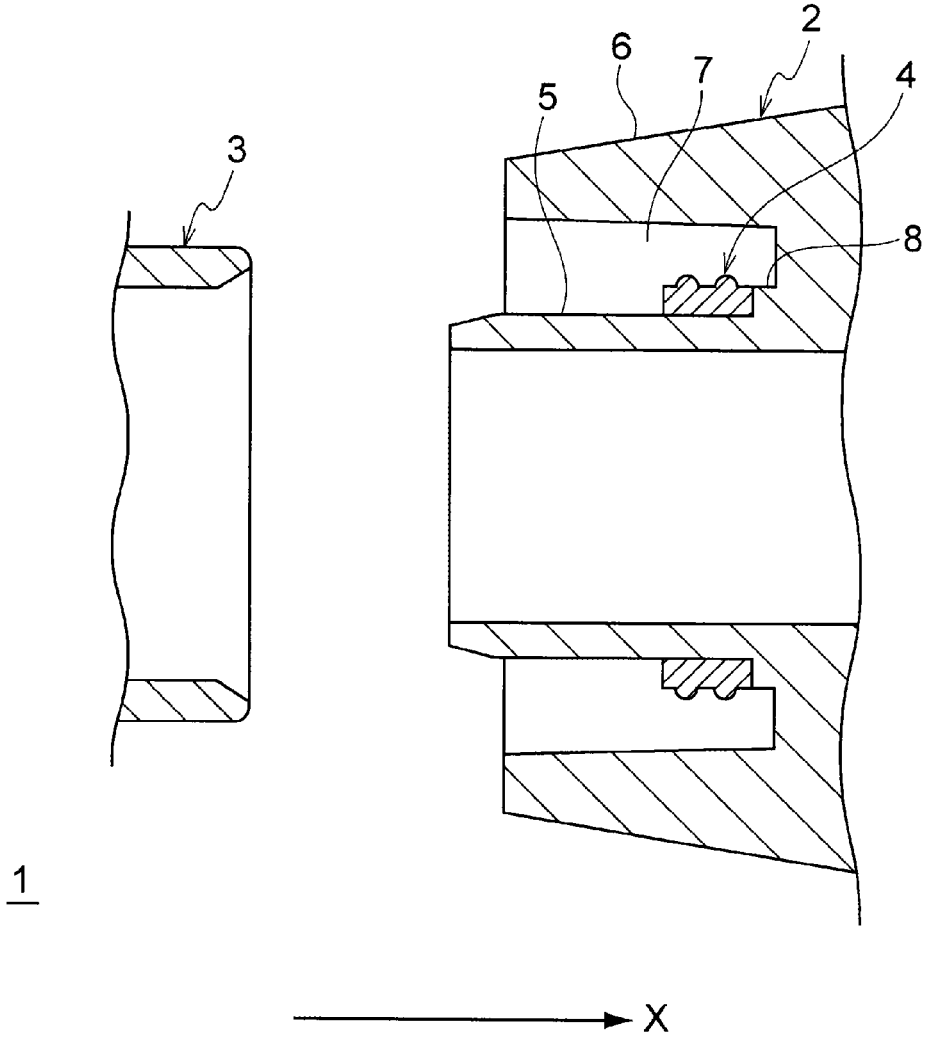
FIG. 1 is a sectional view which shows a rough construction of an embodiment of the sealing structure which uses the sealing member of the present invention.

A sectional view of a sealing structure 1 of the embodiment is shown in FIG. 1. The sealing structure 1 includes a female housing 2 (a first connector housing) and a male housing 3 (a second connector hosing) which are made of synthetic resin, and a sealing member 4 which has an annular shape (a shape in the natural state). The female housing 2 includes a cylindrical inner pipe part 5, which holds inside itself a terminal metal fitting (not shown in figure) to which an electric wire is connected, and an outer pipe part 6, which is arranged coaxially with the inner pipe part 5 and radially outside the inner pipe part 5. An annular receiving space 7 is formed in the gap between the outer peripheral surface of the inner pipe part 5 and the inner peripheral surface of the outer pipe part 6. As described below, the direction (axial direction) shown by the arrow X in FIG. 1 is specified as a front and rear direction, and the right side of the figure is specified as the front side. In other figures, the right side of each figure is specified as the front side like FIG. 1. In addition, in FIG. 1, the electric wire and the terminal metal fitting are omitted.

In the receiving space 7 of the female housing 2, the inner peripheral surface (the outer peripheral surface of the inner pipe part 5) is raised up to have a stepped shape at the inside part of the inner peripheral surface, and is provided with an circular step portion 8 which is formed by increasing diameter. The sealing member 4 is installed along the step portion 8. The front side surface of the sealing member 4 is arranged to face the step portion 8.

The male housing 3 is formed into a cylindrical shape, and holds inside itself a terminal metal fitting (not shown in figure) to which an electric wire is connected. The male housing 3 is inserted into the receiving space 7 of the female housing 2 to be fitted with the inner pipe part 5 of the female housing 2. When the male housing 3 and the female housing 2 are fitted with each other, the terminal metal fittings, which are held inside these two housings, are connected with each other, and electric wires at two sides are connected electrically.

Next, the construction of the sealing member 4 will be described in detail.

Figure 2:
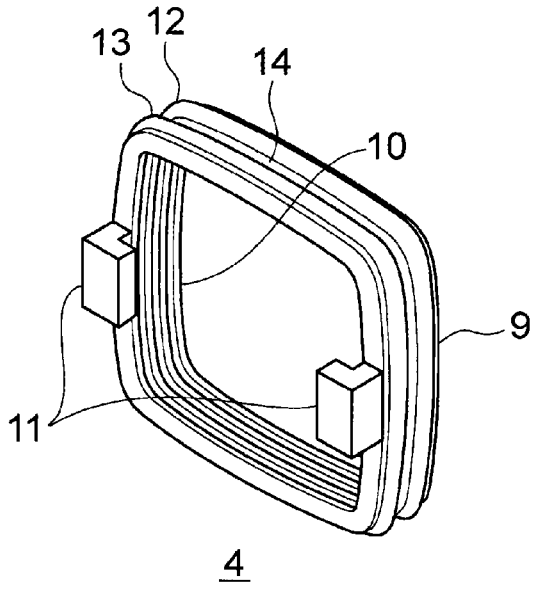
FIG. 2 is an overall perspective view of the sealing members of the present invention.
Figure 3:
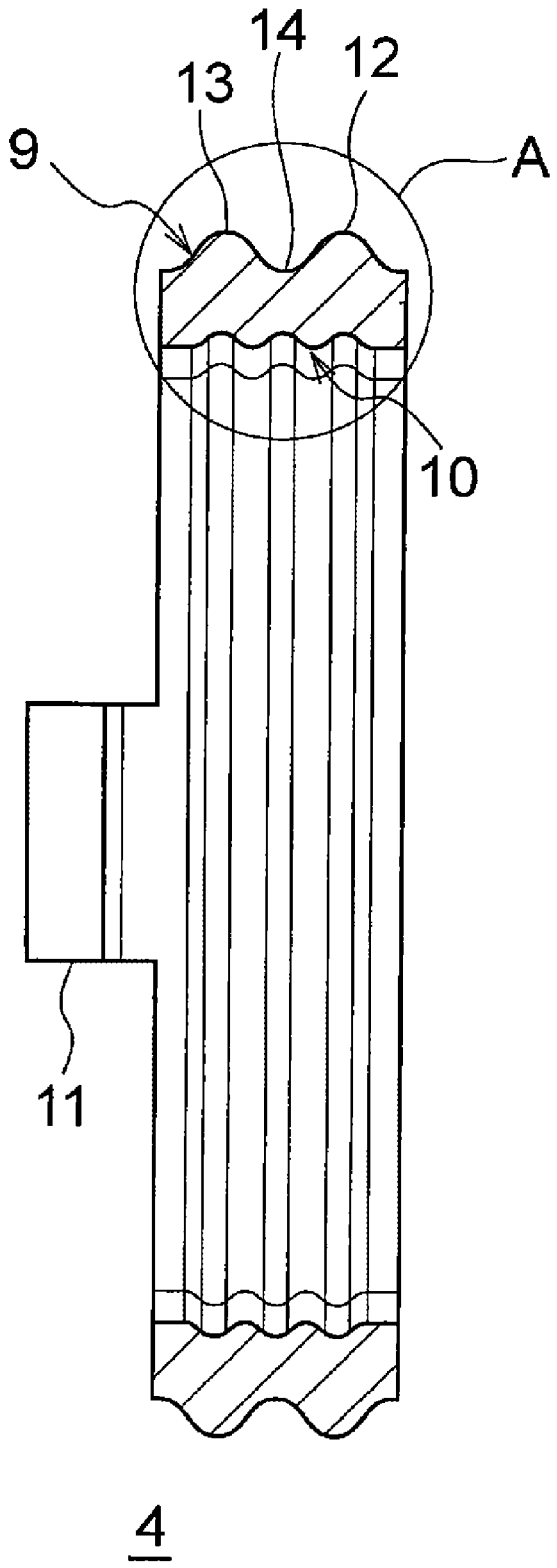
FIG. 3 is a longitudinal sectional view of FIG. 2.
Figure 4:
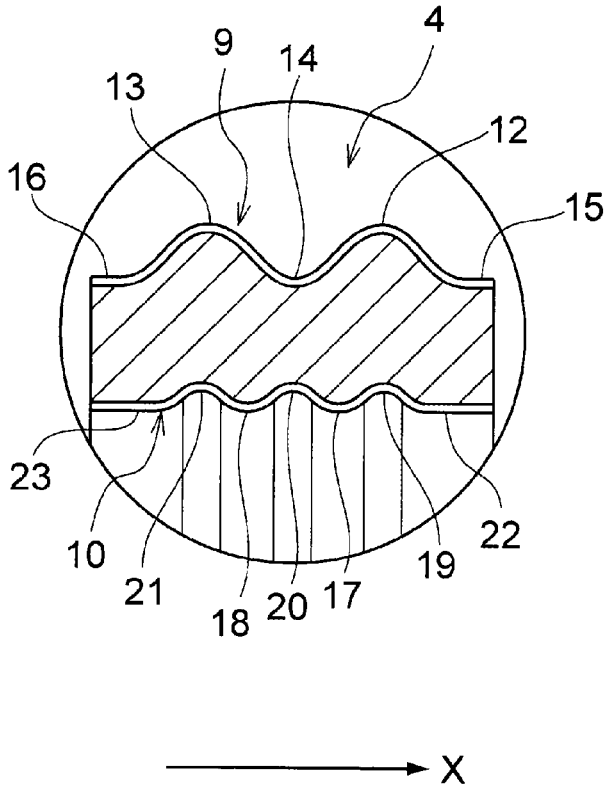
FIG. 4 is an enlarged view of an A part of FIG. 3.

FIG. 2 is a perspective view which shows the appearance of the sealing member 4. FIG. 3 is a longitudinal sectional view of FIG. 2. FIG. 4 is a sectional view which shows that an A part of FIG. 3 is enlarged. As shown in these figures, the sealing member 4 of the embodiment is so formed that the width direction (axial direction) size is larger than the thickness direction size, and an outer peripheral surface 9 and an inner peripheral surface 10 are formed with annular protrusion parts (lip parts) and annular groove parts in the peripheral direction, respectively. An axial end of the sealing member 4 is provided with a pair of hooks 11 used for fixing. The pair of hooks 11, for example, are locked to the front end parts of a pair of slits (not shown in figure), which extend in the axial direction of the inner pipe part 5 of the female housing 2, and regulate the movement of the sealing member 4 in the front and rear direction. The construction to regulate the movement of the sealing member 4 in the front and rear direction is not limited to the hooks 11 of the prevent embodiment, and may use other well-known structures.

As shown in FIG. 4, the outer peripheral surface 9 of the sealing member 4 includes two protrusion parts 12 and 13, and one groove part 14. The front side protrusion part 12 is formed continuously with an annular flat surface 15 at the front side opposite to the groove part 14, and the rear side protrusion part 13 is formed continuously with an annular flat surface 16 at the rear side opposite to the groove part 14. The flat surfaces 15 and 16 are set to have the same height (in the thickness direction) as that of the bottom part (groove bottom) of the groove part 14. On the other hand, the inner peripheral surface 10 of the sealing member 4 includes two protrusion parts 17 and 18, and three groove parts 19, 20, and 21. Among these groove parts, the front side groove part 19 is formed continuously with an annular flat surface 22 at the front side opposite to the protrusion part 17, and the rear side groove part 21 is formed continuously with an annular flat surface 23 at the rear side opposite to the groove part 18. The flat surfaces 22 and 23 are set to have the same height (in the thickness direction) as that of the protrusion parts 17 and 18.

In a region between the flat surfaces 15 and 16 of the outer peripheral surface 9 which sandwich the region inside, and a region between the flat surfaces 22 and 23 of the inner peripheral surface 10 which sandwich the region inside, the sealing member 4 is formed alternately with protrusions and grooves which have sine wave shapes in the axial direction respectively. The height difference between the protrusion and groove of the inner peripheral surface 10 of the sealing member 4, is set to be smaller than the height difference between the protrusion and groove of the outer peripheral surface 9. In other words, the height difference between the top part of the protrusion part 18 and the bottom part of the groove part 20 is set to be smaller than the height difference between the top part of the protrusion part 13 and the bottom part of the groove part 14. The height difference may be the difference in the thickness direction of the sealing member 4, and equals twice as large as the amplitude of the waveform.

The width sizes of the flat surfaces 15 and 16 in the front and rear direction, and the width sizes of the flat surfaces 22 and 23 in the front and rear direction are set to have the same size respectively, and the width sizes of the flat surfaces 22 and 23 in the front and rear direction are set to be larger than those of the flat surfaces 15 and 16.

In the embodiment, the wavelength of the protrusion-groove of the inner peripheral surface 10 of the sealing member 4 is set to be shorter than that of the outer peripheral surface 9, and the protrusion parts 12 and 13 of the outer peripheral surface 9, and the protrusion parts 17 and 18 of the inner peripheral surface 10 are positioned with a shift (in phase) in the front and rear direction (axial direction). In other words, not the protrusion parts 17 and 18, but the bottom parts of the groove parts 19 and 21 are arranged at those parts of the inner peripheral surface 10 which are located at the inner side of the protrusion parts 12 and 13 of the outer peripheral surface 9, respectively. In addition, the bottom part of the groove part 20 is arranged at the part of the inner peripheral surface 10 which is located at the inner side of the bottom part of the groove part 14 of the outer peripheral surface 9. Thus, in the sealing member 4, the top part of the protrusion part 12 and the bottom part of the groove part 19, the top part of the protrusion part 13 and the bottom part of the groove part 21, and the bottom part of the groove part 14 and the bottom part of the groove part 20, are placed to coincide with each other in position in the front and rear direction (axial direction), respectively.

Next, the action of the sealing structure of the embodiment will be described below. First, the sealing member 4 is pushed toward the inner side (front side) of the receiving space 7 along the outer peripheral surface of the inner pipe part 5 of the female housing 2, and the sealing member 4 is installed along the step portion 8. Next, the male housing 3 is inserted into the receiving space 7 of the female housing 2 in which the sealing member 4 is installed. At this time, when the sealing member 4 is compressed by being pressed against the inner peripheral surface of the male housing 3, stress which is generated inside the sealing member 4 acts in the direction in which the inner peripheral surface of the male housing 3 and the outer peripheral surface of the inner pipe part 5 of the female housing 2 are pressed respectively. Therefore, the gap between the inner peripheral surface of the male housing 3 and the outer peripheral surface of the inner pipe part 5 of the female housing is airtightly sealed by the sealing member 4.

Before the action of the sealing member 4 of the embodiment is described, the reason why a traditional typical sealing member rotates and deforms is described with reference to FIG. 6. In the sealing member 50 of FIG. 6, the positions of the top parts of the two protrusion parts 54 and 55 formed on the outer peripheral surface 53 coincide with the positions of the top parts of the two protrusion parts 58 and 59 formed on the inner peripheral surface 57. In this case, a wide gap P is formed between the region of the inner peripheral surface 57 in the front and rear direction, which corresponds to the region between the protrusion parts 54 and 55, and the outer peripheral surface of the first connector housing 51. Thus, when the rear side protrusion part 55 is pressed against the second connector housing 61, because the gap P is formed near the inner peripheral surface 57 at the inner side of the groove part 56, the groove part 56 is easily deformed towards the inner peripheral surface 57, and the protrusion part 55 becomes easy to rotate, deform and fall down. In addition, in the sealing member 50 of FIG. 6, because an engaging margin L1, which is the height difference between the end part of the inner peripheral surface 57 and the top surface of the step portion 52, is relatively small, if the front end part of the inner peripheral surface 57 rises up above the engagement margin L1 with the rotation and deformation of the protrusion parts 54 and 55, as shown in FIG. 6B, the end part of the sealing member 50 rides onto the step portion 52, and is caught.

Figure 5A:
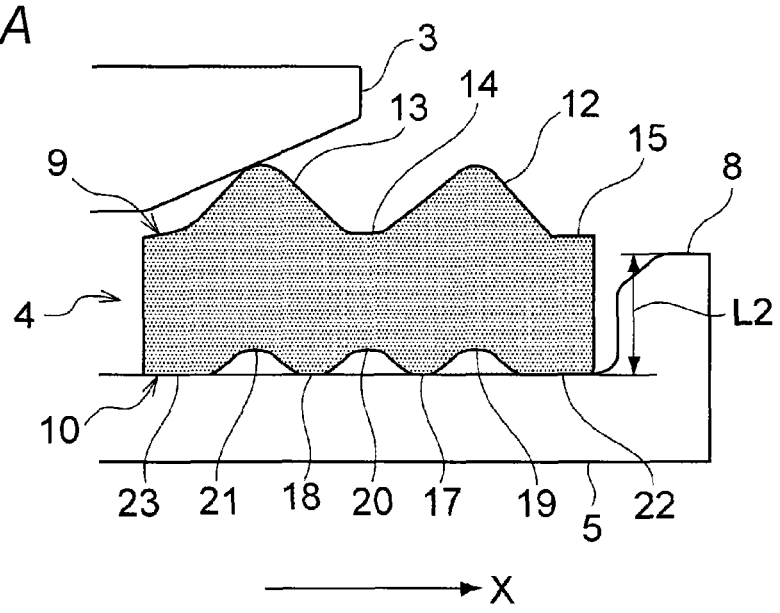
FIGS. 5A and 5B are sectional views which show that the sealing member of the present invention is pressed against connector housings and deforms.
Figure 5B:
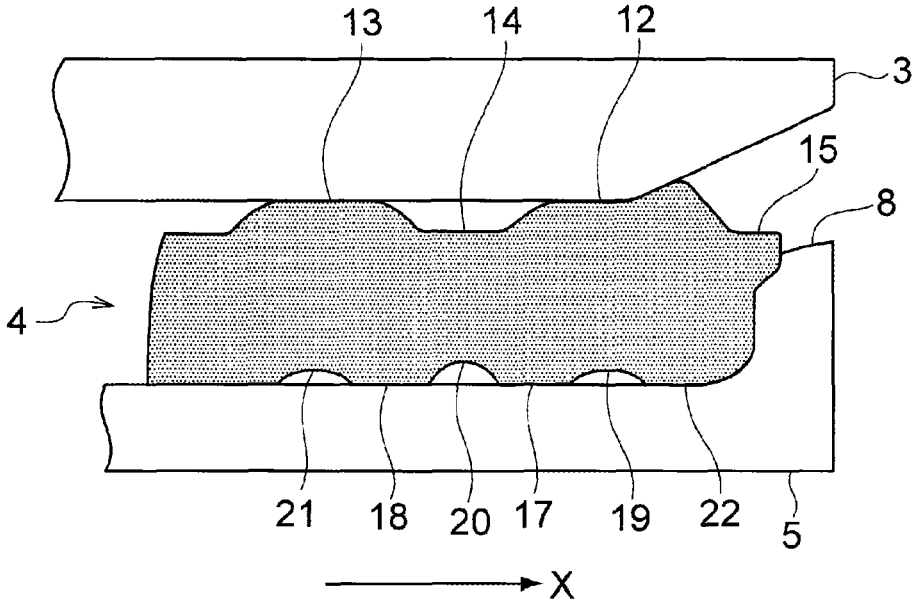

Next, FIG. 5A shows that the sealing member 4 of the present embodiment is installed to the outer peripheral surface of the inner pipe part 5, and FIG. 5B shows that the sealing member 4 is pressed against the male housing 3 and deforms. In the sealing member 4 of the embodiment, because the wavelength of the protrusion-groove of the inner peripheral surface 10 is set to be shorter than that of the protrusion-groove of the outer peripheral surface, and the two protrusion parts 17 and 18 are arranged in the region of the inner peripheral surface 10 in the front and rear direction, which corresponds to the region between the protrusion parts 12 and 13 of the outer peripheral surface 9, the gaps formed between the region of the inner peripheral surface 10 in the front and rear direction and the outer peripheral surface of the inner pipe part 5, are smaller than the gap P of FIGS. 6A to 6C. Therefore, as shown in FIG. 5A, even if the rear side protrusion part 13 is pressed against the male housing 3, the space into which the adjacent groove part 14 is pressed toward the inner peripheral surface 10 can be small, and the two protrusion parts 17 and 18 support the inner peripheral surface 10 from the inner side of the groove part 14. Thereby, the groove part 14 can be inhibited from deforming toward the inner peripheral surface 10. Furthermore, because the bottom parts of the protrusion parts 19 and 21 are arranged at the inner peripheral surface which is at the inner side of the top parts of the protrusion parts 12 and 13, as shown in FIG. 5B, even if the protrusion parts 12 and 13 are pressed against the male housing 3, the protrusion parts 12 and 13 can be inhibited from rotating and deforming because the sealing member 4 deforms in a direction in which the groove parts 19 and 21 are crushed.

In addition, in the sealing member 4 of the embodiment, the front end part of the inner peripheral surface 10 is formed with the flat surface 22, and the flat surface 22, as shown in FIG. 5A, abuts against the outer peripheral surface of the inner pipe part 5 when the sealing member 4 is installed. Therefore, because the engaging margin L2 of the sealing member 4 is longer (roughly double) than the engaging margin L1 of FIG. 6A, even if the flat surface 22 of the front end part of the sealing member 4 rises up slightly, the flat surface 22 will not ride onto the step portion 8, and the sealing member 4 can be prevent from being caught between these two housings. In addition, for the sealing member 4 of the embodiment, even when the male housing 3 is detached from the receiving space 7, because an effect is achieved which is that the groove part 14 is inhibited from being pushed toward the inner peripheral surface 10, the sealing member 4 can be inhibited from being curled or peeled with the rotation and deformation.

Furthermore, in the sealing member 4 of the embodiment, the height difference between the protrusion and groove of the inner peripheral surface 10 is set to be smaller than that of the protrusion and groove of the outer peripheral surface 9. Therefore, a gap, which is formed between a region of the inner peripheral surface 10 in the front and rear direction corresponding to a region between the protrusion parts 12 and 13 of the outer peripheral surface 9 and the outer peripheral surface of the inner pipe part 5, can be reduced, and the groove part 14 can be further inhibited from deforming toward the inner peripheral surface 10.

According to the sealing member 4 of the embodiment, because the protrusion parts 12 and 13 of the outer peripheral surface 9 can be inhibited from rotating and deforming, and the surface pressure can be inhibited from scattering by a plurality of protrusions and grooves which the inner peripheral surface 10 is formed with, although the gap between the inner peripheral surface of the male housing 3 and the outer peripheral surface of the inner pipe part 5 of the female housing 2 is sealed, a sufficient sealing pressure (a sealing pressure which is higher than that of the sealing member 50 of FIG. 6) can be ensured.

The embodiment of the present invention is described above in detail with reference to the figures, but the above embodiment is only an illustration of the present invention, and the present invention is not limited to the constructions of the above embodiment. It is apparent that those modifications in design or the like in a range of not departing from the subject matter of the present invention are included in the present invention.

For example, in the sealing member 4 of the embodiment, it is described as an example that the outer peripheral surface and the inner peripheral surface are provided with two protrusion parts respectively, but the number of the protrusion parts is not limited to this. For example, the outer peripheral surface and the inner peripheral surface may be provided with three or more protrusion parts respectively, and the number of protrusion parts of the inner peripheral surface also may be different from that of the outer peripheral surface. Furthermore, in the sealing member 4 of the embodiment, because the front and rear ends of the inner peripheral surface are provided with the flat surfaces 22 and 23 which have the same width respectively, one merit is obtained which is that the operatively can be improved without regulating the direction, in which the sealing member which is to be fitted is inserted. However, if at least the front end part in the installing direction is provided with a flat surface, when these two connector housings are to be fitted, the sealing member 4 can be inhibited from being caught.

In addition, it is illustrated in the sealing member 4 of the embodiment that the wavelength of the protrusion and groove of the inner peripheral surface 10 is set to be shorter than that of the protrusion and groove of the outer peripheral surface 9, but the wavelength of the protrusion and groove of the inner peripheral surface 10 and the wavelength of the protrusion and groove of the outer peripheral surface 9 may be set to be equal. Even in this case, if the position of the protrusion parts of the inner peripheral surface 10 is arranged with a shift from the position of the protrusion parts of the outer peripheral surface 9 in the front and rear direction (axial direction) of the sealing member 4, because the protrusion part 18 or the protrusion part 17 can be positioned near the inner peripheral surface which is at the inner side of the groove part 14, the protrusion parts 12 and 13 can be inhibited from rotating and deforming. Therefore, the sealing member 4 can be inhibited from being caught.

In addition, it is illustrated in the embodiment that the sealing member 4 is installed along the step portion 8 which the inner pipe part 5 of the female housing 2 is formed with, but the present invention is not limited to this example. For example, the present invention can be applied when the sealing member 4 is installed into an annular groove which the outer peripheral surface of the inner pipe part 5 is formed with.

In the present invention, because protrusion parts can be positioned near the inner peripheral surface which is located at the inner side of the groove parts of the outer peripheral surface of the sealing member, even if the protrusion parts of the outer peripheral surface of the sealing member is pushed to the second connector housing at the time of fitting these two connector housings, the groove parts, which are adjacent to the pushed protrusion parts, can be inhibited from rotating and deforming to the inner peripheral surface. Therefore, because the sealing member can be inhibited from rising up with the rotation and deformation, the sealing member can be inhibited from being caught. In addition, in the sealing member, because the inner and outer peripheral surfaces are formed with protrusions and grooves, a necessary sealing pressure can be ensured.

When the second connector housing pushes the protrusion parts of the outer peripheral surface of the sealing member, because the inner peripheral surface, which is located at the inner side of the protrusion parts, is easily crushed with the groove part as a base point, the protrusion parts of the outer peripheral surface can be inhibited from rotating and deforming.

In addition, because the height difference between the protrusions and grooves of the inner peripheral surface of the sealing member (corresponding to 2 times amplitude) is smaller than the height difference between the protrusions and grooves of the outer peripheral surface, the deformation at the inner peripheral surface side of the sealing member is inhibited, and the protrusion parts of the outer peripheral surface can be inhibited from rotating and deforming.

For example, when the sealing member is installed along the step portion of the outer peripheral surface of the first connector housing with the flat surface of the inner peripheral surface as the front side, even if the front end part of the sealing member rises up slightly, because the engaging margin (height difference between the front end part of the inner peripheral surface and the top surface of the step portion) of the sealing member is large, the front end part (flat surface) of the inner peripheral surface is prevented from riding onto the step portion, and the sealing member can be prevented from being caught.

According to the present invention, the sealing member, which is formed with protrusions and grooves on its inner and outer peripheral surfaces, can be prevented from being caught.

What is claimed is:

1. A sealing member, configured to be installed to an outer peripheral surface of a first connector housing among a pair of connector housings so as to seal a gap between the outer peripheral surface of the first connector housing and an inner peripheral surface of a second connector housing among the pair of the connector housings, wherein an inner peripheral surface of the sealing member is formed with two protrusions and three grooves aligned with a first wavelength in an axial direction of the sealing member, an outer peripheral surface of the sealing member is formed with two protrusions and one groove aligned with a second wavelength in the axial direction, the first wavelength is smaller than the second wavelength, positions of the protrusions of the inner peripheral surface are shifted from positions of the protrusions of the outer peripheral surface in the axial direction, and wherein positions of peaks of the protrusions of the outer peripheral surface coincide with positions of nadirs of the grooves of the inner peripheral surface in the axial direction.

2. The sealing member according to claim 1, wherein a height of the protrusions of the inner peripheral surface from the grooves of the inner peripheral surface is smaller than a height of the protrusions of the outer peripheral surface from the grooves of the outer peripheral surface.

3. The sealing member according to claim 1, wherein at least one of two end parts of the inner peripheral surface of the sealing member in the axial direction is formed with a flat surface, and a height of the flat surface from the grooves of the inner peripheral surface is equal to the height of the protrusions of the inner peripheral surface from the grooves of the inner peripheral surface.

4. The sealing member according to claim 1, wherein the sealing member has an annular shape.

5. The sealing member according to claim 1, further comprising a hook configured to affix to the first connector housing.

6. The sealing member according to claim 5, wherein the hook is configured to be inserted into a slit formed in the outer peripheral surface of the first connector housing.

7. The sealing member according to claim 1, further comprising a plurality of hooks configured to affix to the first connector housing.

8. The sealing member according to claim 7, wherein the plurality of hooks are configured to be inserted into respective slits formed in the outer peripheral surface of the first connector housing.

9. The sealing member according to claim 1, wherein positions of nadirs of the grooves of the outer peripheral surface coincide with positions of nadirs of the grooves of the inner peripheral surface in the axial direction.

10. A sealing structure, comprising:

a first connector housing;

a second connector housing; and a sealing member, installed on an outer peripheral surface of the first connector housing so as to seal a gap between the outer peripheral surface of the first connector housing and an inner peripheral surface of the second connector housing, wherein an inner peripheral surface of the sealing member is formed with two protrusions and three grooves which are aligned with a first wavelength in an axial direction of the sealing member, an outer peripheral surface of the sealing member is formed with two protrusions and one groove which are aligned with a second wavelength in the axial direction, the first wavelength is smaller than the second wavelength, positions of the protrusions of the inner peripheral surface are shifted from positions of the protrusions of the outer peripheral surface in the axial direction, and positions of peaks of the protrusions of the outer peripheral surface coincide with positions of nadirs of the grooves of the inner peripheral surface in the axial direction.

11. The sealing structure according to claim 10, wherein the outer peripheral surface of the first connector housing is formed with a step portion which rises up therefrom, a front surface of the sealing member in an installing direction in which the sealing member is installed to the first connector housing faces the step portion, a front end part of the inner peripheral surface of the sealing member in the installing direction is formed with a flat surface, and a height of the flat surface from the grooves of the inner peripheral surface is equal to the height of the protrusions of the inner peripheral surface from the grooves of the inner peripheral surface.

12. The sealing structure according to claim 10, wherein the sealing member has an annular shape.

13. A sealing member, configured to be installed to an outer peripheral surface of a first connector housing among a pair of connector housings so as to seal a gap between the outer peripheral surface of the first connector housing and an inner peripheral surface of a second connector housing among the pair of the connector housings, wherein an inner peripheral surface of the sealing member is formed with two protrusions and three grooves aligned with a first wavelength in an axial direction of the sealing member, an outer peripheral surface of the sealing member is formed with two protrusions and one groove aligned with a second wavelength in the axial direction, the first wavelength is smaller than the second wavelength, positions of the protrusions of the inner peripheral surface are shifted from positions of the protrusions of the outer peripheral surface in the axial direction, and positions of nadirs of the grooves of the outer peripheral surface coincide with positions of nadirs of the grooves of the inner peripheral surface in the axial direction.

* * * * *